US005840132A

United States Patent [19]

Erdemir et al.

[11] Patent Number: 5,840,132

[45] Date of Patent: Nov. 24, 1998

[54] LUBRICATED BORIDE SURFACES

[75] Inventors: Ali Erdemir, Naperville, Ill.; Cuma Bindal, Sakarya, Turkey; G. R. Fenske, Downers Grove, Ill.

[73] Assignee: ARCH Development Corporation, Chicago, Ill.

[21] Appl. No.: 640,288

[22] Filed: Apr. 24, 1996

[51] Int. Cl.[6] ..... C23C 8/04

[52] U.S. Cl. ..... 148/280; 148/217; 148/279; 148/330

[58] Field of Search ..... 148/279, 267, 148/217, 225, 330, 280

[56] References Cited

U.S. PATENT DOCUMENTS 5,022,933 6/1991 Brandis ..... 148/330

OTHER PUBLICATIONS

"Boric Acid: A Self–Replenishing Solid Lubricant," *Advanced Materials & Processes,* vol. 140, No. 1, pp. 40–42, Jul. 1991.

"Relationship of hertzian contact pressure to friction behavior of self–lubricating boric acid films," Ali Erdemir et al., *Surface and Coatings Technology,* vol. 49, 1991, pp. 435–438.

"Tribological Properties of Boric Acid and Boric–Acid–Forming Surfaces. Part I: Crystal Chemistry and Mechanism of Self–Lubrication of Boric Acid," Ali Erdemir, presented at the 45th Annual Meeting in Denver, Colorado, May 7–10, 1990, published in *Journal of the STLE, Lubrication Engineering,* vol. 47, No. 3, pp. 168–173, Mar. 1991.

"Tribological Properties of Boric Acid and Boric–Acid–Forming Surfaces. Part II: Mechanisms of Formation and Self–Lubrication of Boric Acid Films on Boron– and Boric Oxide–Containing Surfaces," Ali Erdemir et al., presented at the 45th Annual Meeting in Denver, Colorado, May 7–10, 1990, published in *Journal of the STLE, Lubrication Engineering,* vol. 47, No. 3, pp. 179–184, Mar. 1991.

"The Synergistic Effects of Solid and Liquid Lubrication on the Tribological Behavior of Transformation–Toughened $ZrO_2$ Ceramics," A. Erdemir et al., presented at the STLE/ASME Tribology Conference in St. Louis, Missori, Oct. 14–16, 1991, published in *Journal of the STLE, Tribology Transactions,* vol. 35, No. 2, pp. 287–297, 1992.

"A Study of the Formation and Self–Lubrication Mechanisms of Boric Acid Films on Boric Oxide Coatings," A. Erdemir et al., *Surface and Coatings Technology,* vol. 43/44, 1990, pp. 588–596.

"Self–Lubricating Boric Acid Films for Tribological Applications," A. Erdemir et al., presented in the Proceedings of the Japan International Tribology Conference, Nagoya, Japan, 1990.

"Formation and self–lubricating mechanisms of boric acid on borided steel surfaces," A. Erdemir et al., reprinted from *Surface and Coatings Technology,* vol. 76–77, 1995, pp. 443–449.

"Ultralow friction behavior of borided steel surfaces after flash annealing," C. Bindal et al., *Appl. Phys. Lett,* 68(7), 12 Feb. 1996, pp. 923–925.

"Formation of ultralow friction surface films on boron carbide," A. Erdemir et al., *Appl. Phys. Lett.,* 68(12), 18 Mar. 1996, pp. 1637–1639.

"Boric Oxide as a High–Temperature Lubricant," E. Rabinowicz et al., ASME Publication, Paper No. 62–LUBS–17, pp. 1–8.

(List continued on next page.)

*Primary Examiner*—Prince Willis, Jr.
*Assistant Examiner*—Robert R. Koehler
*Attorney, Agent, or Firm*—Michael D. Rechtin; Foley & Lardner

[57] ABSTRACT

Ultralow friction properties available through the annealation and subsequent cooling of various boron-containing substrates, articles and/or components.

24 Claims, 4 Drawing Sheets

OTHER PUBLICATIONS

"Formation and Self–Lubricating Mechanisms of Boric Acid on Borided Steel Surfaces," A. Erdemir et al., presented at International Conference on Metallurgical Coatings and Thin Films in San Diego, Cal., Apr. 26, 1995; Abstract No. E2.06.

Acheson Colloids Co. Product Bulletin, "Acheson's Stable Colloidal Dispersion Containing TEFLON in Oil," No. 13–160–392.

Acheson Colloids Co. Product Bulletin, "Understanding Acheson Solid Lubricant Additives," No. 13–146–RV392.

FIG. 5
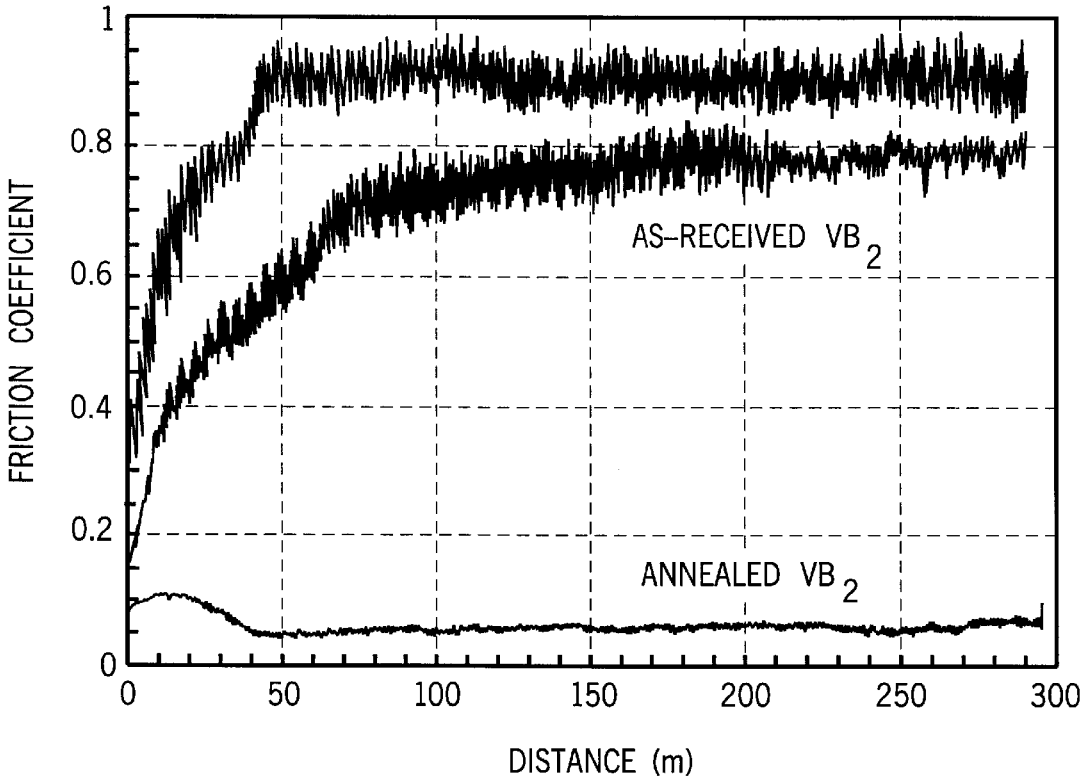
FIG. 6A
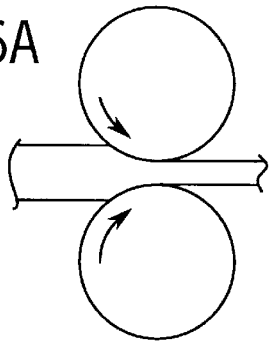
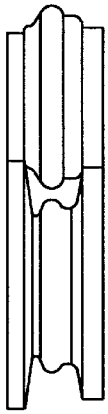
FIG. 6B
FIG. 6C
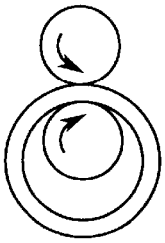
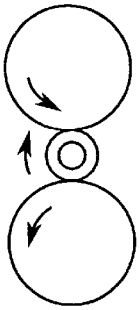
FIG. 6D

LUBRICATED BORIDE SURFACES

This invention was made with Government support under Contract No. W-31-109-ENG-38 awarded by the Department of Energy. The Government has certain rights in this invention.

BACKGROUND OF THE INVENTION

This invention is related generally to lubricated boride surfaces and, more particularly, methods for the in situ lubrication of such surfaces, articles and/or compositions.

Because of its exceptional hardness, outstanding elastic modulus, and low specific gravity, boron carbide ($B_4C$) has been used for a wide range of engineering applications where high wear resistance and light weight are desired. For example, such materials are used as wear parts in grinding wheels and in wheel-dressing sticks for sharpening knives and other cutting edges. Fine powders of boron carbide are used as super abrasives in polishing and grinding of metals and ceramics. In particular, the low specific density and high elastic modulus of boron carbide are exploited in the production of $B_4C$-whisker-reinforced composites. Lightweight armor plates resistant to piercing by bullets are also made of boron carbide. However, despite its excellent wear resistance, boron carbide does not provide low friction properties to sliding surfaces. In fact, because of its hard and abrasive nature, it is subject to high wear rates and material loss when used with mating or contacting surfaces.

Nonetheless, boriding has become a well-known surface diffusion treatment and is used widely to impart high hardness and wear resistance characteristics to various materials, including ferrous alloys. Ordinarily, boriding is achieved using a boron-containing salt bath at temperatures of 800° to 1000° C. In recent years, significant progress has been made in producing such hardness by other techniques that use plasma boriding and low-energy ion implantation. Boron atoms, because of their relatively small size and very mobile nature diffuse easily into the ferrous alloys. Such materials can dissolve iron interstitially, but can also react with it to form FeB and $Fe_2B$. These phases are hard and stable; reported Vickers hardness values for borided steel surfaces range from 13 to 18 GPa.

As with boron carbide, borided materials can provide excellent resistance against adhesive, abrasive, and corrosive wear. Again, however, as with boron carbide, such materials exhibit high hardness and wear resistance characteristics, such that their friction coefficients are relatively high, as can be measured against untreated steel and other engineering alloys.

OBJECTS OF THE INVENTION

It is an object of the present invention to provide lubricated boron carbide, borided articles and/or borided compositions and method(s) for their lubrication, thereby overcoming various deficiencies and shortcomings of the prior art, including those outlined above. It will be understood by those skilled in the art that one or more aspects of this invention can meet certain objectives, while one or more other aspects can meet certain other objectives. Each objective may not apply equally, in all instances, to every aspect of this invention. As such, the following objects can be viewed in the alternative with respect to any one aspect of this invention.

It is an object of the present invention to provide compositions and mechanisms for the solid phase self-lubrication of various boron-containing substrates, articles, and/or surfaces.

It can also be an object of this invention to provide a relatively low-temperature route—in comparison to the prior art—to enhanced lubrication, as evidenced by greatly reduced coefficients of friction.

It can also be an object of this invention to provide boron-containing materials which can be treated under relatively facile conditions—compared to the prior art—to induce self-lubrication from solid interaction effects rather than high liquid viscosities.

It can also be an object of the present invention to provide boron-containing materials for incorporation into articles and/or devices for use in the formation/deformation of various metal or plastic materials.

It can also be an object of the present invention to provide a mechanism by which boron-containing or borided materials, which are otherwise abrasive, are imparted with ultralow friction characteristics imparted through the formation of a solid boric acid film.

Other objects, features and advantages of the present invention will be apparent from the following summary of the invention and its descriptions of various preferred embodiments, and will be readily apparent to those skilled in the art having knowledge of various lubrication systems, components, methods, and techniques. Such objects, features, benefits and advantages will be apparent from the above as taken in conjunction with the accompanying examples, tables, data, figures and all reasonable inferences to be drawn therefrom.

BRIEF DESCRIPTION OF THE DRAWINGS

FIG. 5 shows graphically an extension of the present invention to include self-lubrication using an analogous source of boron, e.g., vanadium boride ($VB_2$) as a representative example of non-carbide boron source of the type described herein.

SUMMARY OF THE INVENTION

Figure 1:
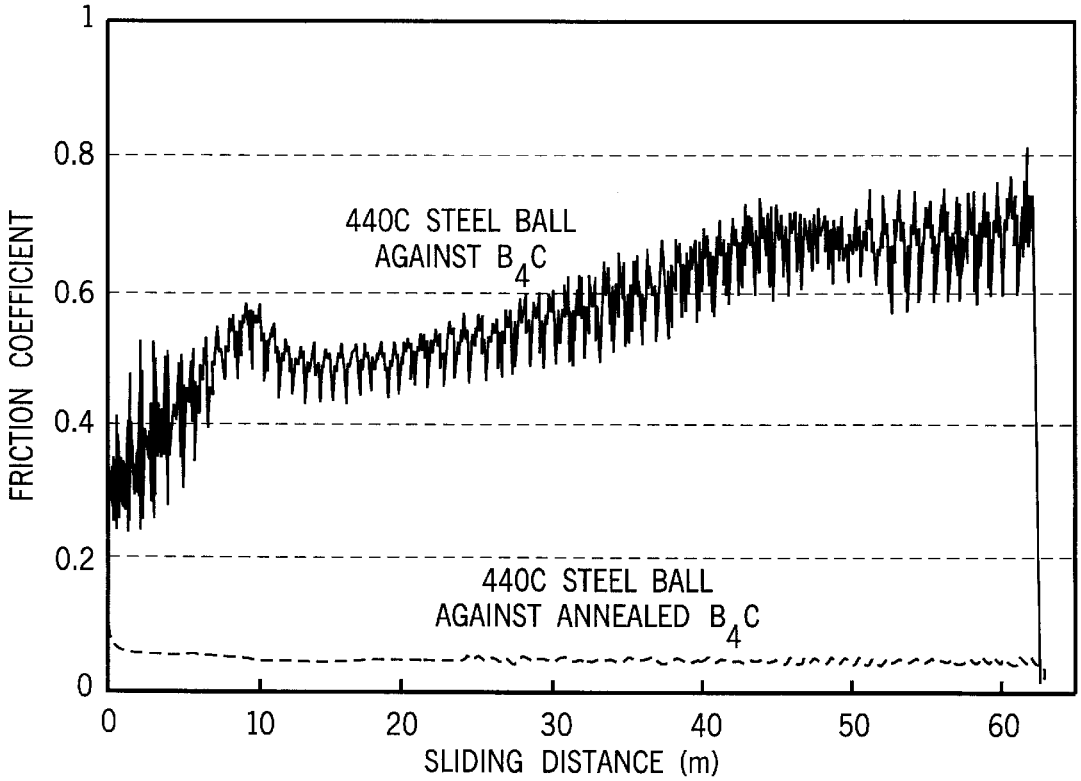
FIG. 1 compares the friction coefficients of 440C steel balls during sliding against as-received and annealed $B_4C$, similar benefits are observed as against other materials such as but not limited to ceramics.

The present invention provides various embodiments of a method(s) for the self-lubrication of boron-containing and/or borided materials, as well as articles and compositions derived therefrom or used in conjunction therewith. As such, the invention overcomes various problems of the prior art, including those mentioned above.

In part, the present invention is a method of using a boride to lubricate the surface of a metallic article. Such a method includes (1) providing a metallic article treated with a reduced boron compound; (2) annealing the article at a temperature between about 400° C. and about 1000° C. for a time sufficient for surface diffusion of boron; and (3) cooling the article in ambient air. Ambient air includes atmospheric conditions under which such inventive methods are utilized and which contain moisture at concentrations sufficient to effect hydration of an oxidized boron moiety. In preferred embodiments, the reduced boron compound can include but is not limited to $VB_2$, TiB, $TiB_2$, $TiB_4$, $B_4C$, BN, $ZrB_2$, $ZrB_3$, $ZrB_4$ or a combination of such compounds, which can be used to treat a suitable metallic article.

In highly preferred embodiments, the reduced boron compound is boron carbide and, alternatively, a suitable annealing temperature is about 600° C. to about 800° C. An article with which the inventive method is utilized can be prepared by one of several known metals or alloys. However, in highly preferred embodiments, the metallic article comprises steel treated with boron carbide, such that annealation is accomplished with a sufficient temperature maintained for a period of about three to about eight minutes.

In part, the present invention is a method of lubricating the surface of a boron-containing substrate. Such a method includes (1) providing a substrate composed, at least partially, of a boron compound; (2) heating the substrate to a temperature of about 400° C. to about 1000° C.; and (3) cooling the substrate in ambient air. As mentioned above, ambient air includes a moisture concentration sufficient to impart lubricity to the substrate materials affected by such a method. In preferred embodiments, the boron component of the substrate can include but is not limited to $VB_2$, TiB, $TiB_2$, $TiB_4$, $B_4C$, BN, $ZrB_2$, $ZrB_3$, $ZrB_4$ or a combination of said compounds. See, for example, FIG. 5.

In highly preferred embodiments, the boron component is boron carbide and, alternatively, the substrate is heated to a temperature of about 600° C. to about 800° C. Where the substrate is a borided steel heating at such temperatures is maintained for a period of about three minutes to about eight minutes.

In part, the present invention includes a composition having a raman spectrum exhibiting reflectance of radiation at about 496–498 $cm^{-1}$ and about 877–879 $cm^{-1}$, with such a composition obtainable by annealing an article at least partially comprised of boron carbide in ambient air for a period of at least about three minutes, before cooling the article in ambient air. In preferred embodiments, where the article is borided steel, a temperature of about 600° C. to about 800° C. is employed and maintained for a period of about three minutes to about eight minutes.

In part, the present invention is also an article of the type used in forming metal or plastic materials, with the article including a metallic component having a surface for contacting the material. Articles of the type considered herein include those having the components shown schematically in FIG. 6. An improvement to the article includes a borided metallic component having a layered crystalline film of boric acid on the surface thereof. In preferred embodiments, the metallic component of such an article can be borided using such boriding reagents as $VB_2$, TiB, $TiB_2$, $TiB_4$, $B_4C$, BN, $ZrB_2$, $ZrB_3$, $ZrB_4$ or a combination of said compounds. Other boriding reagents and associated techniques can be utilized, as would be well known to those skilled in the art.

In highly preferred embodiments, the metallic component of such an article is borided with boron carbide, such that the boric acid film on the metallic component is the hydration product of atmospheric moisture on the annealed surface of the borided component. Likewise, the borided metallic component is preferentially annealed at a temperature of about 400° C. to about 1,000° C., and/or for a time sufficient for surface diffusion of boron. In highly preferred embodiments, where the metallic component is borided steel, an annealing temperature of about 600° C. to about 800° C. for a time of about three minutes to about eight minutes provides the desired improvement, as can be evaluated by the measured friction coefficients.

As mentioned above, the present invention includes an annealing procedure that results in the formation of a super-slippery boric acid film on hard boron-containing substrates. Where the substrate is boron carbide, this film provides friction coefficients of 0.03 to 0.05 against sliding steel surfaces. The annealing procedure is efficient and effective, involving heating the $B_4C$ to high temperature (e.g., above about 400° C. in open air) and maintaining such a temperature for a short duration and sufficient time to effect oxidation of the boron species by the surrounding atmosphere. During subsequent cooling to room temperature, a secondary reaction is believed to involve atmospheric moisture and the formation of a thin boric acid, $H_3BO_3$, film that provides the ultralow friction characteristics observed.

Figure 2:
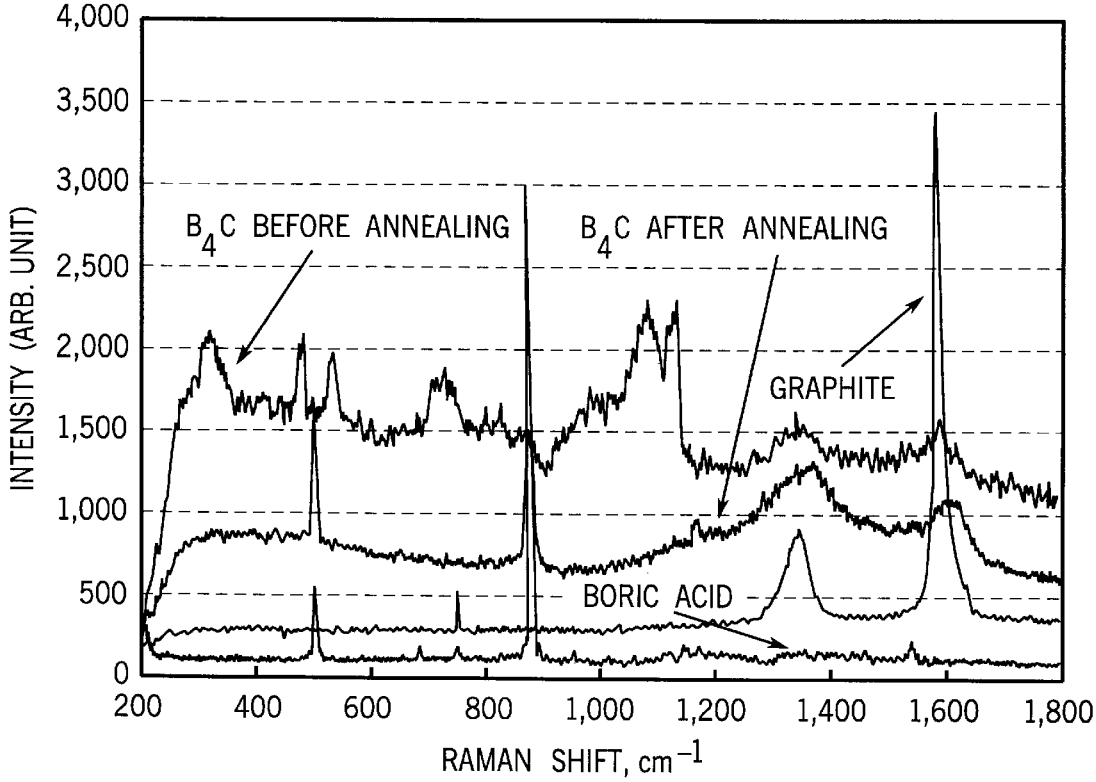
FIG. 2 shows the Raman spectra of as-received and annealed $B_4C$. Raman spectra of $H_3BO_3$ (boric acid) and graphite standards are also included.

Raman spectroscopy of the annealed $B_4C$ reveals two strong Raman bands: one centered at approximately 498 $cm^{-1}$ and the other at 879 $cm^{-1}$ (see FIG. 2). These values are very close to those (i.e., 500 and 881 $cm^{-1}$) of bulk boric acid ($H_3BO_3$). For further confirmation, reagent-grade $H_3BO_3$ powders from a commercial vendor were analyzed with Raman spectroscopy, with the Raman spectrum of this $H_3BO_3$ also shown in FIG. 2 for purposes of comparison. As is clear, the Raman spectrum of the reagent grade $H_3BO_3$ overlaps that formed on the surface of $B_4C$ after annealing. The Raman spectrum of the as-received $B_4C$ is also included in FIG. 2, and as can be seen it is very different from those of the slippery surface film and $H_3BO_3$ standard. The Raman spectrum of annealed $B_4C$ reveals two broad peaks centered at around 1350 and 1580 $cm^{-1}$ which suggest that some degree of graphitization may have also occurred under the conditions employed. The Raman spectrum of as-received $B_4C$ also exhibited broad peaks corresponding to the principal Raman bands of graphite. However based on the spectra given in FIG. 2, it is difficult to estimate the quantitative amounts of graphite before and after annealing at 800° C.

Without restriction to any one theory or mode of operation and based on the chemical and spectral analyses presented herein, it is believed that the ultralow friction coefficients of annealed $B_4C$ surfaces are directly related to the formation of $H_3BO_3$ film on the exposed surface. During heating and/or annealation, boron and carbon gain the high activation energies required for oxidation. It is known that $B_4C$ is thermodynamically stable up to 600° C., but at temperatures of 600° C. and higher oxidation starts and proceeds at a slow rate. See, F. Thevenot, J. Eur. Ceram. Soc., 6, 202 (1990); D.-H. Riu, R. Choi, H.-E. Kim, and E.-S Kang, J. Mat. Sci., 30, 3897 (1995); V. A. Lavrenko and Yu. G. Gogotsi, Oxiation of Metals, 29, 193 (1988). Thereafter, the boron moiety can undergo a secondary reaction with moisture in air (because of a negative standard heat of reaction), resulting in a thin boric acid film on the exposed surface of the article and/or substrate.

Again, without limitation, it is believed that the ultralow friction mechanism involving a boric acid film, is related to the fact that boric acid crystallizes in a layered triclinic crystal structure. See, A. Erdemir, Lubr. Eng., 47, 168

(1991). The atomic layers are parallel to the basal plane and are made up of boron, oxygen, and hydrogen atoms. These atoms are closely packed and strongly bonded to each other by covalent, ionic, and hydrogen bonds, whereas the atomic layers are widely spaced and held together by weak forces, e.g., van der Waals. Mechanistically, it can be envisioned that under shear forces, platelike crystallites of solid boric acid align themselves parallel to the direction of relative motion; once so aligned, they can slide over one another with relative ease—interacting solid to solid—to provide the low friction coefficients shown in FIG. 1.

As illustrated in the figures and non-limiting examples, this invention can also be extended to include the lubrication of various borided surfaces. In one embodiment, the result is the formation of a lubricious film on a borided steel surface and a friction coefficients as low as 0.05. As detailed herein, the invention includes exposing a borided surface (steel or other suitable metal or diffusable material) to suitable temperatures (e.g., 600° to 800° C.) for 3 to 8 min. (using steel) and then cooling it to room temperature in open air. During the exposure to such a temperature, some of the boron atoms in the borided layer gain sufficient activation energy for diffusion and migrate to the surface. A secondary reaction with atmosphere moisture forms a thin boric acid film that is believed responsible for the ultralow friction characteristics observed. See, FIG. 3.

Without limitation, it is believed that at about 750° C., the atomic species within the borided surface layer become very mobile. In particular, the diffusivity of boron (perhaps because of its small atomic size and higher diffusion coefficient) in borided layer increases markedly. It is known that boron has a diffusion coefficient of about 3.74 $cm^2/s$ in bonded steels at 750° C. As it reaches the surface, it can react quickly with oxygen; the standard heat of reaction for boron oxidation at 750° C. is −296.5 kcal/mol.

Without limitation, it is further believed that at least some of the atoms that participate in solid-state diffusion and/or oxidation reaction during annealing are interstitial boron atoms, not reacted with iron: during exposure to 750° C., the rate of diffusion of free B in borided layer increases dramatically, and extraction of B from FeB or $Fe_2B$ would be expected to be very difficult, mainly because of the very short annealing time. Furthermore, FeB and $Fe_2B$ are thermodynamically very stable. For these reasons, the possibility of FeB or $Fe_2B$ dissociating into Fe and B, with subsequent diffusion to the surface to form a layer of complex oxides is thought to be rather remote.

As mentioned above, in the boron carbide context, further reaction with moisture in air results in the formation of a thin boric acid film on the surface of the composition, article or substrate. As previously described by Erdemir, boric acid crystallizes in a layered triclinic crystal structure. In a manner analogous to the carbide embodiment described above, it is believed that the ultralow friction measured on the borided and annealed steel is a direct consequence of the formation of a boric acid film thereon and the beneficial solid interaction effects derived therefrom.

EXAMPLES OF THE INVENTION

The following non-limiting examples and data illustrate various aspects and features relating to the articles/compositions and/or methods of the present invention, including the self-lubrication mechanism(s) available through use of the boron-containing materials described herein. Given the prior art, the lubrication previously attempted through use of boric oxide and the inherent limitations thereof, the results/data provided herein are surprising, unexpected, and contrary to the prior art. While the utility of this invention is illustrated through use of several boron compounds and/or borided substances, it will be understood by those skilled in the art that comparable results are obtainable with various other boron compounds and/or borided substances, commensurate with the scope of this invention The $B_4C$ material used was hot-pressed and obtained from a commercial source. The test pieces were cut into squares having nominal dimensions of 35×35×6 mm. The surface finish of the test pieces was 0.1 μm center-line-average (CLA). The annealing heat-treatment for oxidation was done in a box furnace at 800° C. for one hour.

Friction and wear tests were performed with both the heat-treated and control samples in a ball-on-disk tribometer under a load of 5N, at room temperature (about 23°C.), and in open air of 50±5% relative humidity. Rotational speed was 5 r $min^{-1}$ which translated into a sliding velocity of 5.2 $mms^{-1}$. The counterface material was made of 440C steel balls, 9.5 mm in diameter, with a highly polished surface finish of better than 0.01 μm CLA roughness. Laser-Raman spectroscopy was used to characterize the structure and chemical nature of the sliding surfaces. The Raman spectroscope used a HeNe laser at 632.8 nm with an output power of 25 mW focused to a spot size of 2 to 3 μm.

The substrate materials/articles used were from a low-carbon steel containing 0.3 wt % C, 0.02 wt % P, and 0.5 wt % Mn. The square test pieces had nominal dimensions of 15×15 mm and 6 mm; surface finish of the test pieces was 0.05 μm center-line average (CLA).

Boriding was done in a salt bath consisting of 66 wt % borax, 14 wt % boric acid, and 20 wt % ferrosilicon at 940° C. and at atmospheric pressure for a period of 5 to 7 hours. Additional specifications relating to boriding processes are as described in the Bindal thesis, referenced above. Such procedures, specifications and processes are well-known to those skilled in the art and readily-applicable to this invention.

With respect to the borided materials, friction tests were performed with both the borided and unborided substrates in a pin-on-disk tribometer under a load of 5N, at room temperature (about 23°C.) and in open air of 50% ±5% relative humidity. Rotational speed was 6 rev $min^{-1}$, and depending on the diameter of each wear track, sliding velocity ranged from 2 to 4 mm $s^{-1}$. Friction tests with pairs were allowed to continue until a steady-state friction regime reflecting the real frictional behavior was established. Unborided and borided/annealed samples reached steady states fairly quickly, while borided steel took several hundreds of sliding cycles before establishing a steady-state friction regime. The counterface material was a $Si_3N_4$ ball, 9.5 mm in diameter, with a highly polished surface finish of better than 0.01 μm CLA roughness. Laser-Raman spectroscopy was also used to characterize the structure and chemical nature of the borided surfaces. The Raman spectroscope used a HeNe laser at 632.8 nm with an output power of 25 mW focused to a spot size of 2 to 3 μm.

EXAMPLE 1

Referencing FIG. 1, the friction coefficients of 440C steel balls sliding against $B_4C$ were measured before and after annealing. As is clear, the friction coefficient of 440C steel against $B_4C$ is initially low (about 0.3), but increases substantially as sliding continues and reaches a value of 0.7 toward the end of the test. This result verifies further than $B_4C$ is not a low-friction material. The specific wear rate of the 440C steel ball slid against $B_4C$ was $2.9\times10^{-5}$ $mm^3 \cdot N^{-1}m^{-1}$, which can be considered as rather high.

EXAMPLE 2

Using the apparatus of Example 1 and by comparison, the friction coefficient of a 440C steel ball sliding against the annealed $B_4C$ surface is initially 0.07, but as sliding continues it decreases to 0.04 and remains constant for the rest of the test. This demonstrates clearly that the method(s) described herein lead to the formation of a very slippery surface film on $B_4C$. Furthermore, the specific wear rate of the 440C ball was much less, at $3\times10^{-7}mm^3N^{-1}m^{-1}$, indicating that the lubricious film formed on the surface reduced the wear rate of the steel ball by nearly two orders of magnitude. Comparable results are available using alternate boron compounds of the type disclosed herein. See, for example, FIG. 5.

EXAMPLE 3

Figure 3:
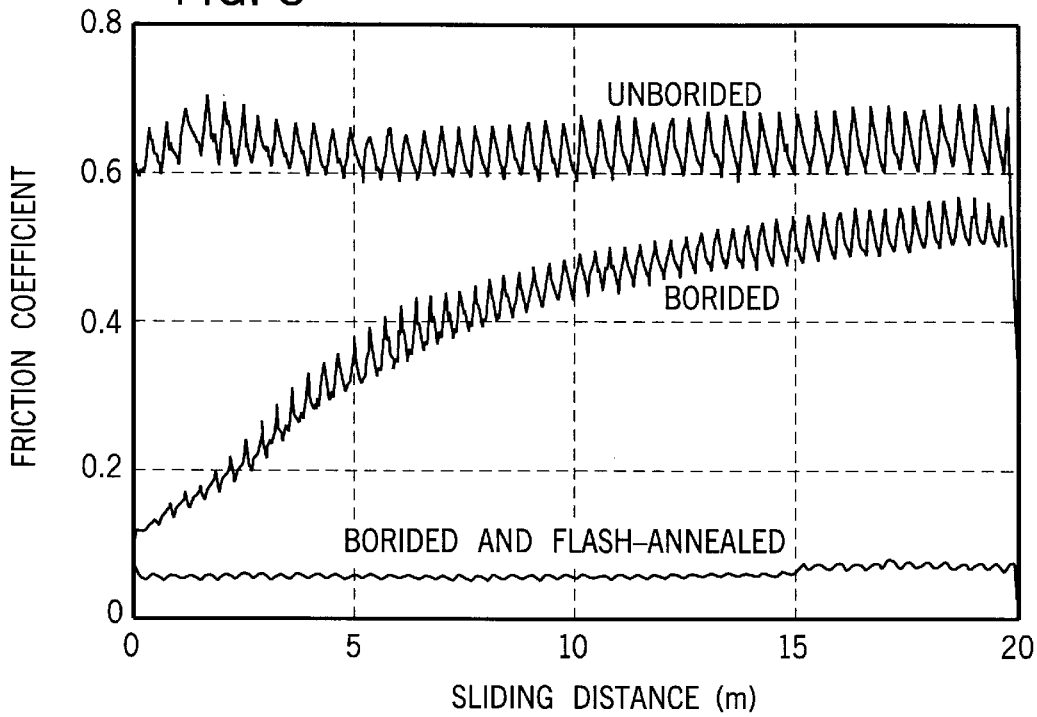
FIG. 3 shows the variation of coefficients of friction arising from $Si_3N_4$, balls sliding against unborided, borided only, and borided/annealed steel as a function of sliding distance.

FIG. 3 shows the range of friction coefficients of $Si_3N_4$ balls during sliding against unborided, borided, and borided-annealed samples. As is clear, the friction coefficient of the $Si_3N_4$ ball sliding against the borided steel is initially low (about 0.1), but increases substantially as sliding continues and reaches 0.5. The friction coefficient of $Si_3N_4$ against unborided steel is also high, i.e., 0.63. These experiments demonstrate that boriding alone does not significantly lower friction. However, as is also shown in FIG. 3, the method(s) of this invention result in an order-of-magnitude reduction in friction. The friction coefficient of a $Si_3N_4$ ball sliding against the borided/annealed steel surface is initially 0.07, but as sliding continues it decreases further to 0.06 where it was observed to remain constant.

EXAMPLE 4

Figure 4:
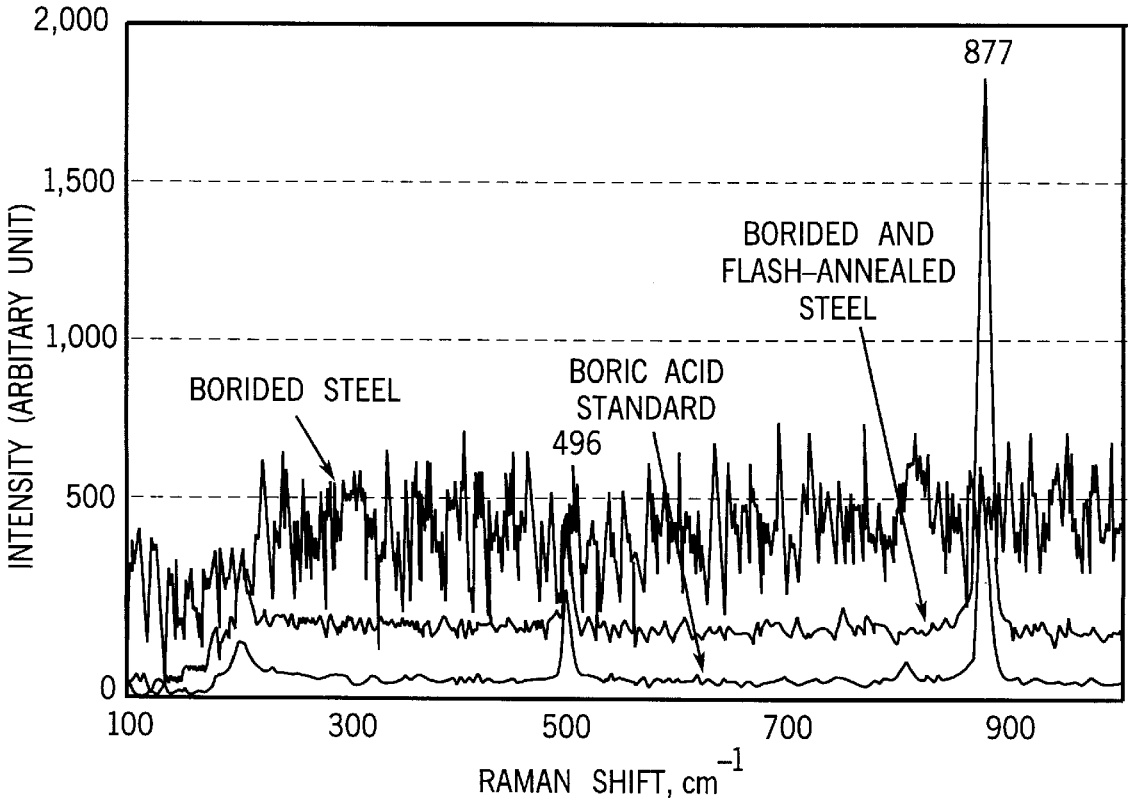
FIG. 4 shows comparative Raman spectra of borided steel, borided/annealed steel, and a boric acid standard.
Figure 6E:
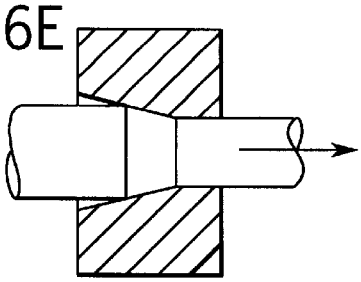
FIG. 6 shows schematically various articles and/or components of the type used in metal and/or plastic formation/deformation, including but not limited to (a) rolling-flat, (b) rolling-shape, (c) rolling-ring, (d) rolling-tube; (e) drawing-wire/bar, (f) drawing-tube, (g) extrusion-solids, (h) extrusion-tube; (i) forging-open die, 0) forging-impression die, and (k) forging-closed die components—all of which are in accordance with the present invention.
Figure 6G:
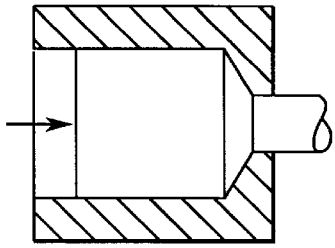
Figure 6F:
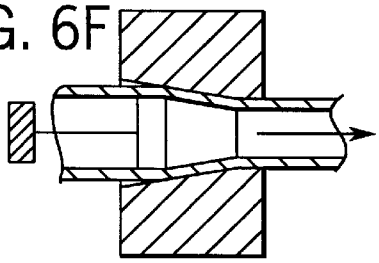
Figure 6H:
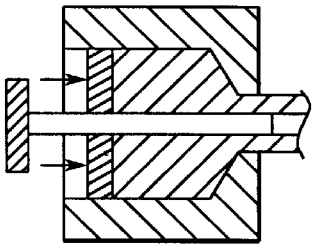
Figure 6I:
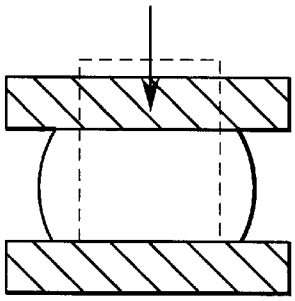
Figure 6J:
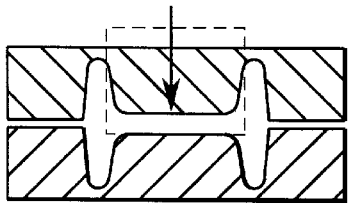
Figure 6K:
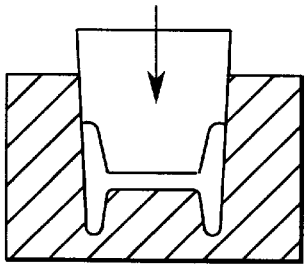

The results presented in FIG. 3 demonstrate clearly that the present method(s) leads to the formation of a lubricious film on the sliding surfaces of borided steels. Raman spectroscopy in this context also reveals two strong Raman bands; one centered at approximately 496 $cm^{-1}$ and the other at 877 $cm^{-1}$ (see FIG. 4). These values are very close to those (i.e., 500 and 881 $cm^{-1}$) of the bulk boric acid ($H_3BO_3$) reported in the literature. The Raman spectrum of bulk boric acid is also included in FIG. 4 for comparison. As is clear, this spectrum overlaps perfectly with that from the surface of annealed borided steel. As is seen in FIG. 4 the Raman spectrum of borided steel is very different from those of the boric acid standard and annealed samples; it does not reveal any particular Raman band. In short, the ultralow friction coefficient of borided/annealed surface (see FIG. 3) must be casually-related to the formation of a thin boric acid film on the exposed surface.

While the principles of this invention have been described in connection with specific embodiments, it should be understood clearly that these descriptions are added only by way of example and are not intended to limit, in any way, the scope of the invention. Other advantages and features will become apparent from the claims hereinafter, with the scope of the claims determined by the reasonable equivalents, as understood by those skilled in the art.

We claim:

1. A method of using a reduced boride compound to lubricate a surface of a metallic article, comprising:

providing a metallic article treated with a reduced boron compound disposed on the surface of the metallic article, the reduced boron compound forming an exterior surface;

annealing said metallic article at a temperature between about 400° C. and about 1000° C. in an oxidizing atmosphere for a time sufficient for diffusion of boron to the exterior surface; and exposing the exterior surface to ambient air to form a layer of boric acid for improved lubricity for the metallic article.

2. The method of claim 1 wherein said reduced boron compound is selected from the group $VB_2$, TiB, $TiB_2$, $TiB_4$, $B_4C$, BN, $ZrB_2$, $ZrB_4$ or a combination of said compounds.

3. The method of claim 1 wherein said reduced boron compound is boron carbide.

4. The method of claim 1 wherein said annealing temperature is about 600° C. to about 800° C.

5. The method of claim 1 wherein said annealing temperature is maintained for a period of about three minutes to about eight minutes.

6. The method of claim 1 wherein said metallic article comprises steel and boron carbide.

7. A method of lubricating a surface of a reduced boron-compound containing substrate, said method comprising:

providing a substrate comprising a reduced boron compound layer disposed at least on an exterior surface of the substrate;

heating said substrate to a temperature of about 400° C. to about 1000° C. in an oxidizing atmosphere during at least part of the heating step to form a boron oxide; and exposing said reduced boron compound to ambient air, thereby forming a boric acid layer on the reduced boron compound layer.

8. The method of claim 7 wherein said reduced boron compound is $VB_2$, TiB, $TiB_2$, $TiB_4$, $B_4C$, BN, $ZrB_2$, $ZrB_3$, $ZrB_4$ or a combination of said compounds.

9. The method of claim 8 wherein said reduced boron compound is boron carbide.

10. The method of claim 9 wherein said annealing temperature is about 600° C. to about 800° C.

11. The method of claim 10 wherein said annealing temperature is maintained for a period of about three minutes to about eight minutes.

12. The method of claim 9 wherein said substrate comprises a borided steel.

13. A boron containing composition having a surface layer with a raman spectrum showing radiation reflectance at about 498 $cm^{-1}$ and at about 879 $cm^{-1}$, said composition obtainable by annealing an article comprising boron carbide in ambient air at a temperature between about 400° C. and about 1000° C. for a period of about three minutes to about eight minutes to form a boric acid containing layer on a boron carbide containing layer.

14. The composition of claim 13 wherein said temperature is about 600° C. to about 800° C.

15. An article used in forming metal or plastic materials, said article including a metallic component having a surface for contacting the material, the improvement comprising:

a reduced borided metallic component layer on the metallic component surface having a layered crystalline film of boric acid forming an exterior surface on the reduced borided metallic component disposed on the metallic component surface.

16. The article of claim 15 wherein said metallic component is borided to include $VB_2$, TiB, $TiB_2$, $TiB_4$, $B_4C$, BN, $ZrB_2$, $ZrB_3$, $ZrB_4$ or a combination of said compounds.

17. The article of claim 16 wherein said component includes boron carbide.

18. The article of claim 15 wherein said boric acid is the hydration product of moisture on the annealed surface of the borided metallic component.

19. The article of claim 18 wherein the borided-metallic component is annealed at a temperature of about 400° C. to about 1000° C. for a time sufficient for surface diffusion of boron.

20. The article of claim 19 wherein the borided metallic component is annealed at a temperature of about 600° C. to about 800° C. for a time of about three minutes to about eight minutes.

21. In an article used in forming metal or plastic materials, the article including a component having a surface for contacting the material, the improvement comprising a reduced boride contacting component and boric acid on the surface of said reduced boride contacting component, said contacting component comprising a boride compound selected from the group consisting of $VB_2$, $TiB_2$, $TiB_1$, $B_4C$, BN, $ZrB_2$, $ZrB_3$, $ZrB_4$ and a combination of said boride compounds.

22. The article of claim 21 wherein said contacting component is boron carbide.

23. The article of claim 21 wherein said contacting component is annealed at a temperature of about 400° C. to about 1000°C.

24. The article of claim 21 wherein said boric acid is the hydration product of moisture and the surface of the contacting component annealed at a temperature of about 400° C. to about 1000°C.

* * * * *